US008178356B2

(12) United States Patent
Sukhija et al.

(10) Patent No.: US 8,178,356 B2
(45) Date of Patent: May 15, 2012

(54) METHOD FOR EVALUATION OF PERFORMANCE OF PERCOLATION TANKS USING ENVIRONMENTAL CHLORIDE AS A TRACER

(75) Inventors: Balbir Singh Sukhija, Andhra Pradesh (IN); Dontireddy Venkat Reddy, Andhra Pradesh (IN); Pasupuleti Nagabhushanam, Andhra Pradesh (IN); Mutyala Venkata Nandakumar, Andhra Pradesh (IN)

(73) Assignee: Council of Scientific & Industrial Research, New Delhi (IN)

( * ) Notice: Subject to any disclaimer, the term of this patent is extended or adjusted under 35 U.S.C. 154(b) by 500 days.

(21) Appl. No.: 12/281,153

(22) PCT Filed: Mar. 30, 2007

(86) PCT No.: PCT/IN2007/000129

§ 371 (c)(1),
(2), (4) Date: Aug. 29, 2008

(87) PCT Pub. No.: WO2007/113853

PCT Pub. Date: Oct. 11, 2007

(65) Prior Publication Data

US 2009/0012722 A1 Jan. 8, 2009

(30) Foreign Application Priority Data

Mar. 30, 2006 (IN) ..... 886/DEL/2006

(51) Int. Cl.
*G01F 23/00* (2006.01)
*G01N 31/00* (2006.01)

(52) U.S. Cl. ..... 436/125; 436/124; 702/25; 702/50; 702/55; 702/33; 702/1; 702/23; 702/22

(58) Field of Classification Search ..... 436/125, 436/124; 702/25, 55, 50, 33, 1, 23, 22
See application file for complete search history.

(56) References Cited

U.S. PATENT DOCUMENTS 5,667,336 A 9/1997 Zur
2004/0211731 A1 10/2004 Ferguson et al.

OTHER PUBLICATIONS

Sukhija, B et al., Development of a simle tracer method to assess contribution of artificial recharge ponds to augment groundwater resources, 1998, Artificial Recharge of Groundwater, Proceedings of the International Syposium on Artificial Recharge of Ground Water, 339-341.*

Turner, J. V., et al. "Determination of groundwater flow-through regimes of shallow lakes and wetlands from numerical analysis of stable isotope and chloride tracer distribution patterns." *Journal of Hydrology* (2006) vol. 320, No. 3-4, pp. 451-483.

* cited by examiner

*Primary Examiner* — Christine T Mui
(74) *Attorney, Agent, or Firm* — Ladas & Parry LLP

(57) ABSTRACT

Naturally present chloride concentration in natural water is utilized for the development of the technique to gauge the performance of percolation tanks in space and time. The chloride mass balance technique is simple, sensitive, reliable and yet powerful enough to resolve the temporal variation due to the effect of silting or climate factors. The percolation efficiency data of percolation tanks can aid in the formulation of guidelines for selection of suitable sites for future tanks with greater efficiency. Otherwise unscientific construction of percolation tanks in sites that yield poor percolation efficiency is uneconomical, and the very purpose of their construction will be forfeited. Thus the technique developed using chloride mass balance in tank water for evaluation of tank performance is highly economy oriented.

8 Claims, 2 Drawing Sheets

Temporal variation of volume of water and its chloride concentration in percolation tank

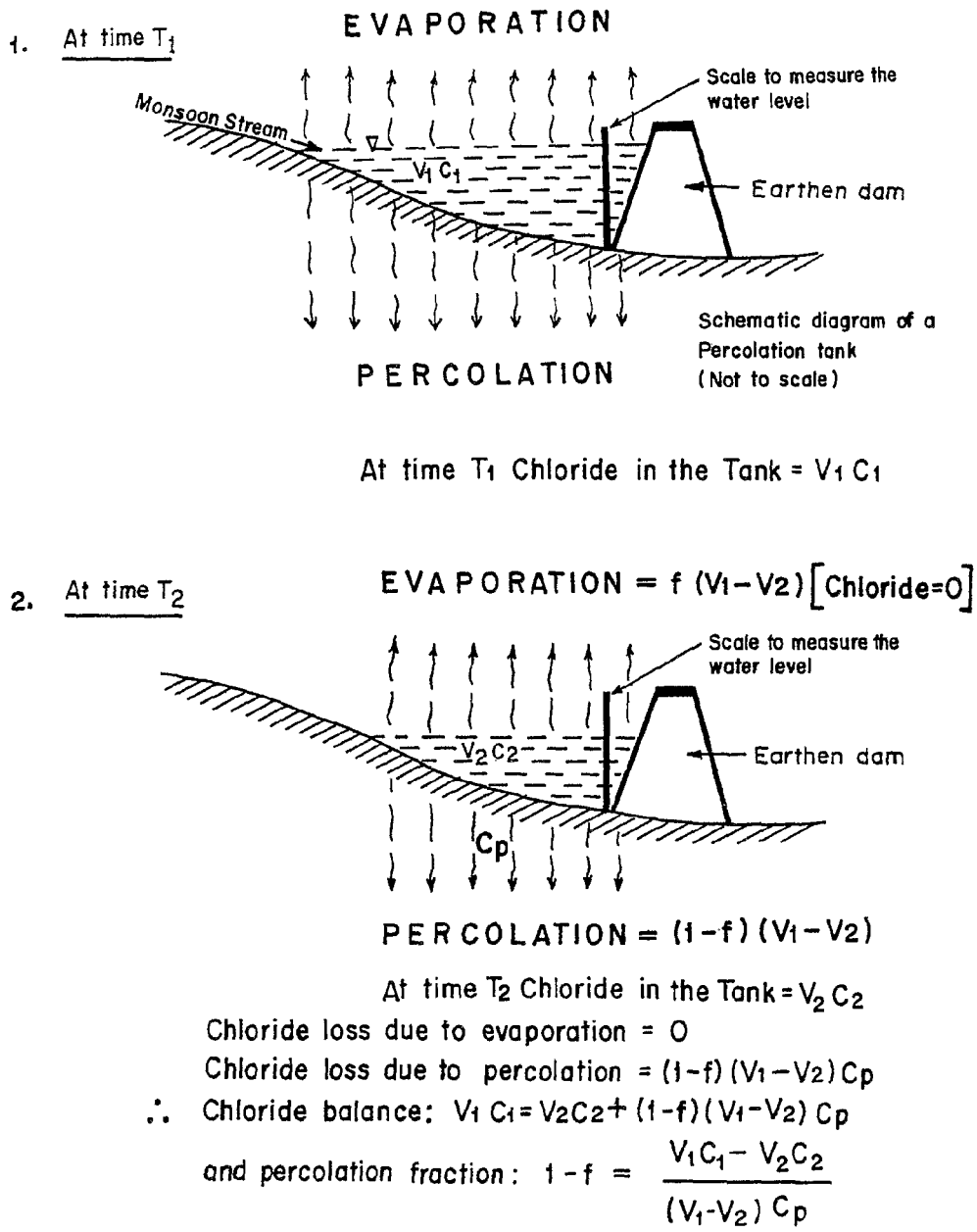
Fig.1: Principle of Environmental Chloride Mass Balance Technique to evaluate performance of percolation tanks

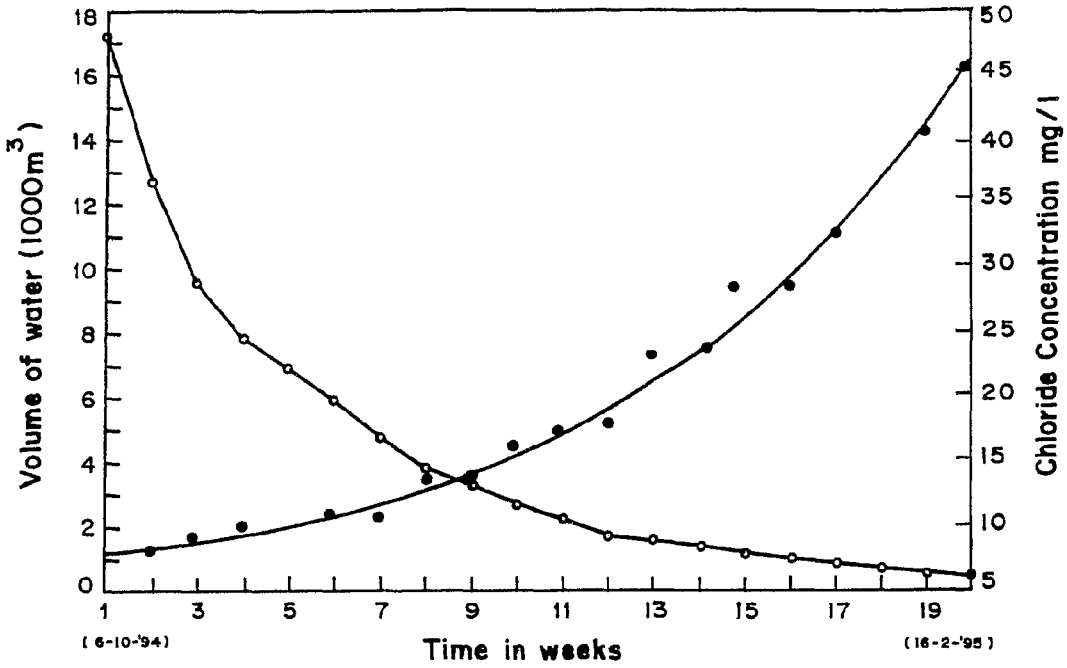
Fig.2: Temporal variation of volume of water and its chloride concentration in percolation tank

METHOD FOR EVALUATION OF PERFORMANCE OF PERCOLATION TANKS USING ENVIRONMENTAL CHLORIDE AS A TRACER

FIELD OF THE INVENTION

The present invention relates to a method for the evaluation of percolation tanks using environmental chloride as a tracer. The present invention particularly relates to a method for evaluation of percolation tanks performance using environmental chloride present in surface water as a tracer.

The present invention relates to a method for the evaluation of percolation tanks using environmental chloride as a tracer, with regard to the contribution of such tanks for groundwater augmentation.

BACKGROUND OF THE INVENTION

Percolation tanks are artificial recharge structures used to augment groundwater resources. Percolation tanks are simple earthen dams constructed across natural ephemeral streams, so that surface runoff is impounded in these structures. Due to evaporation losses, only a certain fraction of impounded water is subsequently expected to percolate through the tank bed and improve the yield of the downstream wells. However, scientific studies to evaluate the efficacy of Percolation tanks are very few. Water balance method (Raju, 1985) is generally employed for estimating tank contribution to groundwater augmentation. The water balance method takes into account the pan-evaporation measured at meteorological stations, rather than measuring it near the tanks. Such pan-evaporation data may not really applicable to large tanks and hence usage of such non-in situ (tank) measured pan-evaporation values in the evaluation of tank performance runs in to ambiguous results. On the other hand, tank contribution to groundwater could be qualitatively assessed by analyzing the stable isotope contents of tank water and groundwater (Nair et el., 1979) or injecting a tracer in to the tank and monitoring the tracer in the downstream wells (Nair et al., 1980). Thus the present invention offsets the ambiguity associated with the water balance and other tracer studies and provides quantitatively the contribution from percolation tank to groundwater.

Radioactive tracers used for such studies pose handling and hazardous problems. Hence evaluation of efficiency of percolation tanks warrants development of techniques making use of environmental tracers (such as chloride) present in rain water (tank water).

Reference may be made to the study by Raju (1985) [Raju, K. C. B. (1985). Recharge through percolation tanks and subsurface dykes, India, Proc. Semi. On "Artificial recharge of groundwater" held at Ahmedabad, India, p. 12C-1], wherein the study has evaluated the performance of percolation tanks using conventional water balance method i.e., the impounded water in the tank is equated to the sum of remaining water and the total loss of water from the tank. The total loss of water from the tank is the sum of evaporation and percolation. Here the evaporation value is taken from the meteorological station which is situated quite far away from the tank. The drawback of the study is usage of such non-insitu evaporation data for the water balance study which results in ambiguous estimates of percolation.

Another reference may be made to the study by Nair et al. (1979) [Nair, A. R., Pendharkar, A. S., Navada, S. V. and Rao, S. M. (1979). Groundwater recharge studies in Maharashtra: Development of isotope techniques and field experience. Isotope Hydrology 1978, IAEA-SM-228-240., II,: p. 803-826], wherein they studied the Shindawane percolation tank, Pune District, Maharashtra using δD of tank water, canal water and groundwater to evaluate tank influence area. The study segregated the wells into three groups based on their δD content. Group-I wells mainly recharged by the tank; Group-II wells getting feed from both tank and canal; and the Group-III mainly recharged by the canal. Thus the stable isotope study has provided qualitatively the influence of Shindawane percolation tank on the groundwater regime. The drawbacks associated with the stable isotope study are: the deuterium isotope measurement requires sophisticated and very costly equipment (about Rs. 150.00 lakhs) and moreover requires highly skilled manpower for handling stable isotope samples and measurements.

Yet another reference may be made to the study by Nair et al. (1980) [Nair, A. R., Jain, S. K., Rao, S. M., and Eapen, A. C (1980). Radiotracer technique to study the efficacy of Bangarwadi percolation tank. Proc. Workshop on "Nuclear Techniques in Hydrology", held at Hyderabad, India, p.219-230], wherein radioactive tritium tracer in the form of tritiated water was injected in to the Bangarwadi percolation tank to evaluate its contribution to the groundwater and groundwater flow conditions. Their study could only identify the direction of the movement of percolating water towards irrigation wells in the down stream, but could not evaluate quantitatively the efficacy of the percolation tank. The drawbacks associated with this study are: usage of radioactive tracer which has inherent problems of safe handling otherwise health of the handling personnel is at risk; collection, transportation and measurement of tritiated water samples is to be carried out by trained and skilled personnel; and requires sophisticated and costly equipment for tritium measurement; disposal of the tritiated samples is a problem and one should take utmost care in this aspect and follow safety norms.

OBJECTS OF THE INVENTION

It is an object of the invention to provide a method for the use of non-radioactive tracers for evaluation of percolation tanks, thereby minimizing or avoiding the environmental hazards and operational hazards associated therewith.

SUMMARY OF THE INVENTION

Accordingly the present invention provides a method for the evaluation of the performance of percolation tanks using environmental chloride as a tracer, the method comprising generating a rating curve representing stage versus volume, periodically collecting the tank water and measuring the water level in the tank, measuring evaporation levels, and measuring the chloride concentration of collected tank water samples, estimating an initial total chloride in the tank water at the time of start of process, estimating residual chloride in the tank, water at a given time, computing the loss of chloride from tank water to groundwater through percolation, mass balancing the chloride concentration in the tank water, to provide the volume of water percolated to groundwater.

In one embodiment of the present invention water level in the tank is recorded daily and the volume of water in the tank estimated.

In another embodiment of the invention evaporation is recorded daily from the pan-evaporimeter installed at the tank.

In another embodiment of the present invention loss of chloride from tank water to groundwater through percolation is estimated.

In another embodiment of the present invention mass balance of chloride concentration in the tank water is made and the volume of water percolated from tank to groundwater is computed.

In yet another embodiment, volume of water in the tank at any instant is estimated from the depth of the water column and the area occupied by the water body at the time of measurement, thereby enabling generation of the rating curve of stage versus volume.

In yet another embodiment, the tank water chloride measurements is carried out over a week using a spectrophotometer, and water level in the tank is recorded daily using an installed staff gauge.

In a further embodiment, the percolation fraction or tank efficiency is evaluated over four or six weekly periods during which period changes in the chloride concentration is observed, the computations being performed as moving four or six weekly averages so that temporal variation, if any, can be observed.

In another embodiment of the invention, any rainfall event during the process period is noted and eliminated, and the chloride mass balance is computed for the successive dry period only.

In another embodiment, seepage, if any, is channelised and measured using v-notch and chloride content thereof is also measured to account for chloride loss.

BRIEF DESCRIPTION OF THE ACCOMPANYING DRAWINGS

In the drawing accompanying this specification,

FIG. 1 represents the above principle of environmental chloride mass balance technique to evaluate performance of percolation tanks, and FIG. 2 represents the temporal variation of volume of water and its chloride concentration in percolation tank as a result of evaporation and percolation.

DETAILED DESCRIPTION OF THE INVENTION

Environmental chloride finds its application in various geohydrological studies primarily due to its conservativeness and ease of measurement. Despite its potential as a tracer, no attempt was made to use it for artificial recharge studies. Environmental chloride is deposited on the land from the atmosphere by rainfall and dry fall out. The fall out is more along the coast and decreases with increasing distances from the coast. The contribution from rainfall is measurable, but the contribution from dry fall out especially in the inland area is negligible. Thus in case of percolation tanks, chloride input from dry fall out is expected to be negligible since the chloride from dry fall out is dissolved in the surface runoff and reaches the tank as initial input. Post monsoon component of dry fall out chloride, over the tank water spread area, is relatively small and its effect on the change in chloride concentration of tank water during the experimental period is negligible and hence the dry fall out chloride input is not considered for computations.

After impoundment of surface runoff in the tank, it is assumed that no additional sources or sinks of chloride affects the chloride concentration of tank water, and the tank water is lost primarily by evaporation and percolation only, and seepage from the dam, if any, should be accounted. Mass balance of chloride in the tank water can serve for estimation of percolated fraction of total volume of water. The residual chloride in the tank soil after the tank dries up, would mix back with the tank water during the next phase of tank impoundment. As the water level in the tank and its chloride concentration measurements, for chloride mass balance, start from the end of monsoon till the time the tank completely dries up, the effect of residual chloride on the chloride mass balance is considered insignificant. The total chloride content of tank water at any time during the experimental period is computed from the volume of tank water at that time and its chloride content measured every week from the cessation of monsoon. The chloride concentration in the tank water increases with time due to evaporation of tank water and there is no loss of chloride due to evaporation. The percolating tank water contains chloride, and hence the chloride loss is accounted. Therefore measurement of volume of tank water and its chloride concentration at different times enables estimation of percolation fraction of tank water.

The chloride mass balance in the tank water between times t1 and t2 is computed following the relation:

$$V1*C1=V2*C2+(1-f)*(V1-V2)*Cp$$

where

V1=volume of tank water (after monsoon) at time t1,

C1=chloride concentration of tank water at time t1,

V2=volume of tank water at time t2,

C2=chloride concentration of tank water at time t2, f=fractional loss of tank water by evaporation, 1−f=tank water percolation fraction/efficiency, V1−V2=loss of tank water between times t1 and t2, f*(V1−V2)=loss of tank water by evaporation, (1−f)*(V1−V2)=loss of tank water by percolation, Cp=Σ(Ci*Vi)/(Σ Vi)=weighted average of chloride concentration in percolated water.

Then the percolated fraction is:

$$1-f=[(V1*C1)-(V2*C2)]/[(V1-V2)*Cp]$$

Thus the percolated fraction (volume of artificial recharge) from the percolation tank can be computed by measurement of various parameters mentioned above. For obtaining the chloride balance at any time, the volume of water and its chloride content are to be known. Volume of water in the tank at any instant can be estimated from the depth of the water column and the area occupied by the water body at that time. For this, a rating curve representing stage vs volume is required to be generated. A close interval topographic survey of the tank bed has to be made and volume of water for each centimeter height is to be calculated.

The chloride concentration of tank water needs to be measured regularly at weekly intervals using spectrophotometer, and water level in the tank has to be recorded daily using the installed staff gauge. The tank efficiency (i.e., percolation fraction) is calculated over four or six weekly periods during which time significant changes in chloride concentration can be observed. The computations are performed as the moving four or six weekly averages so that temporal variation, if any, can be observed clearly. Any rainfall event during the experimental period is to be noted, eliminated and the chloride mass balance is to be computed for the successive dry period only. Seepage, if any, needs to be channelised and measured using v-notch and its chloride content is to be measured in order to account for chloride loss.

The present invention provides a method for the use of environmental chloride as a tracer for evaluation of performance of percolation tanks. The method comprises generation of a rating curve representing stage versus volume, periodic collection of tank water, measurement of water level in the tank, measurement of evaporation, measurement of chloride concentration of tank water samples, estimation of initial total chloride in the tank water at the time of start of experiment, estimation of residual chloride in the tank water at a given time, computation of loss of chloride from tank water to groundwater through percolation, and making mass balance of chloride concentration in the tank water, which provides the volume of water percolated to groundwater.

The water level in the tank is preferably recorded daily and the volume of water in the tank estimated. Similarly, evaporation is recorded daily from the pan-evaporimeter installed at the tank. Loss of chloride from tank water to groundwater through percolation is estimated. Mass balance of chloride concentration in the tank water is made and the volume of water percolated from tank to groundwater is computed.

In the present invention, for the chloride mass balance of tank water at any time, the volume of water and its chloride content are to be known. Volume of water in the tank at any instant can be estimated from the depth of the water column and the area occupied by the water body at that time. For this, a rating curve is to be generated representing stage vs volume. A close interval topographic survey of the tank bed has to be made and volume of water for each centimeter height is to be evaluated.

The tank water chloride measurements are to be carried out regularly, say over a week, using spectrophotometer, and water level in the tank has to be recorded daily using the installed staff gauge. The tank efficiency (i.e., percolation fraction) is evaluated over four or six weekly periods during which period significant changes in the chloride concentration can be observed. The computations are performed as the moving four or six weekly averages so that temporal variation, if any, can be observed clearly. Any rainfall event during the experimental period is to be noted and eliminated, and the chloride mass balance is to be computed for the successive dry period only. Seepage, if any, needs to be channelised and measured using v-notch and its chloride content is also to be measured to account for chloride loss. Finally chloride mass balance in tank water is to be made for the time period t1 and t2 using equation 1, and compute the volume of water percolated from tank to groundwater using the equation 2.

Process Flow Chart to Compute Functional Efficiency of Percolation Tanks

1. Generation of rating curve representing stage vs volume for the selected percolation tank
2. Periodic sampling of percolation tank water
3. Measurement of chloride concentration of tank water
4. Measurement of water level in the tank from the staff gauge installed in the tank
5. Measurement of evaporation from the pan-evaporimeter
6. Computation of average chloride concentration in the tank water during the time interval t1 and t2
7. Mass balance of total chloride in the tank water (using equation 1) during the time interval t1 and t2
8. Computation of percolation fraction of impounded water (using equation 2) (i.e., percolation tank efficiency)

Commercial value of the invented technique: Percolation tanks involving very heavy investments are being constructed to artificially enhance groundwater recharge to aquifers by harnessing surface run-off of monsoon streams by constructing simple earthen dams across them. Functional efficiency of percolation tanks in space and time is not thoroughly and quantitatively assessed. The present invention using environmental chloride mass balance in tank water is simple, sensitive, reliable and also powerful enough to resolve the temporal variation due to the effect of silting or climate factors. The percolation efficiency data of percolation tanks can aid in the formulation of guidelines for selection of suitable sites for future tanks with greater efficiency. Otherwise unscientific construction of percolation tanks in sites that yield poor percolation efficiency is uneconomical, and the very purpose of their construction will be forfeited. Thus the technique developed using chloride mass balance in tank water for evaluation of tank performance is highly economy oriented.

The novelty of the present invention lies in the fact that the environmental chloride present in natural water is made use of rather than using costly and hazardous chemicals and radioactive substances in evaluating the performance of percolation tanks. Chloride measurements are simple and require relatively low cost equipment.

The inventive steps are generation of rating curve representing stage vs volume of water for the percolation tank, estimation of volume of water in the tank and its chloride content prior to experimentation, periodic collection of tank water samples and measurement of its chloride concentration, measurement of tank water level and computation of volume of water present, measurement of evaporation, computation of loss of chloride to groundwater through percolation, mass balance of total chloride in the tank water for the time interval t1 and t2, and estimation of tank efficiency (i.e., volume of water percolated from tank to groundwater).

The following example is given by way of illustration and therefore should not be construed to limit the scope of the present invention.

EXAMPLE 1

In the case of percolation tanks situated in basaltic region characterized by relatively low hydraulic conductivity, the percolation efficiency determined using the present development of environmental chloride mass balance technique is about 20 to 30%, while the percolation tanks situated in fractured granitic region having relatively high hydraulic conductivity showed percolation efficiency of 30 to 45%, and the percolation tanks in high hydraulic conductivity zone of sandstone formation registered an efficiency of ~60%. Thus the developed environmental chloride mass balance technique is very sensitive in identifying the spatio-temporal variations in percolation efficiency of percolation tanks.

The main advantage of the present invention is that the naturally present chloride tracer in waters is made use of rather than using costly and hazardous chemicals and radioactive substances in evaluating the functional efficacy of percolation tanks, which also involve an additional expenditure while handling.

The invention claimed is:

1. A method for evaluation of a percolation tank comprising the steps of:

(i) determining a relationship between water level in the percolation tank at a given time and volume of water in the percolation tank at the given time, wherein the determining comprises conducting a topographic survey of a bed of the percolation tank and using the survey to generate a rating curve that allows a determination of the volume of water in the tank from measurement of a level of water in the tank;

(ii) measuring the water level in the percolation tank at each of times t1 and t2 and ascertaining the volume of water in the percolation tank at each of times t1 and t2 from the relationship determined in step (i);

(iii) measuring the chloride concentration in the percolation tank at each of times t1 and t2;

(iv) computing average chloride concentration in the percolation tank during time interval t1 and t2, and (v) calculating a mass balance of total chloride in the water in the percolation tank during time interval t1 and t2 to ascertain the fraction of water that percolated from the percolation tank to groundwater during the time interval.

2. A method as claimed in claim 1, wherein a measurement of the water level in the tank is recorded daily and the volume of water in the tank is ascertained daily from the measurement.

3. A method as claimed in claim 1, wherein evaporation is recorded daily from the pan-evaporimeter, and wherein the pan-evaporimeter is installed at the tank.

4. A method as claimed in claim 1, wherein the chloride concentration in the percolation tank is measured over a week with a spectrophotometer, and the water level in the tank is recorded daily with a staff gauge installed in the percolation tank.

5. A method as claimed in claim 1, wherein the percolation fraction is evaluated over four or six weekly periods during which period changes in the chloride concentration are observed whereby the evaluation can be adjusted for temporal variations the.

6. A method as claimed in claim 5 wherein any rainfall event during the process period is noted and the evaluation is adjusted by taking account of the rainfall and computing the mass balance of total chloride for dry periods only.

7. A method as claimed in claim 5 wherein seepage is channelized and measured with a V notch weir and a chloride content thereof is also measured to account for chloride loss.

8. A method as claimed in claim 1, wherein the percolated fraction is ascertained in step (vi) using the following equation (1) or (2)

$$V1*C1=V2*C2+(1-f)*(V1-V2)*Cp \qquad \text{Equation (1)}$$

where V1=volume of tank water at time t1,

C1=chloride concentration of tank water at time t1,

V2=volume of tank water at time t2,

C2=chloride concentration of tank water at time t2, f=fractional loss of tank water by evaporation, 1−f=tank water percolation fraction/efficiency, V1−V2=loss of tank water between times t1 and t2, f*(V1−V2)=loss of tank water by evaporation, (1−f)*(V1−V2)=loss of tank water by percolation, Cp=Σ(Ci*Vi)/(Σ Vi)=weighted average of chloride concentration in percolated water, wherein therefore the percolated fraction is:

$$1-f=[(V1*C1)-(V2*C2)]/[(V1-V2)*Cp] \qquad (2).$$

* * * * *